US008597398B2

(12) United States Patent
Flemings et al.

(10) Patent No.: US 8,597,398 B2
(45) Date of Patent: Dec. 3, 2013

(54) METHOD OF REFINING THE GRAIN STRUCTURE OF ALLOYS

(75) Inventors: Merton C. Flemings, Cambridge, MA (US); David V. Ragone, Westwood, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 63 days.

(21) Appl. No.: 13/256,187

(22) PCT Filed: Mar. 17, 2010

(86) PCT No.: PCT/US2010/027575

§ 371 (c)(1), (2), (4) Date: Sep. 12, 2011

(87) PCT Pub. No.: WO2010/107859

PCT Pub. Date: Sep. 23, 2010

(65) Prior Publication Data

US 2012/0000317 A1 Jan. 5, 2012

Related U.S. Application Data

(60) Provisional application No. 61/210,500, filed on Mar. 19, 2009.

(51) Int. Cl.
*C22B 9/00* (2006.01)

(52) U.S. Cl.
USPC ..... 75/507; 75/414; 75/10.15

(58) Field of Classification Search
USPC ..... 75/507
See application file for complete search history.

(56) References Cited

U.S. PATENT DOCUMENTS

| | | | | |
|---|---|---|---|---|
| 3,615,354 | A * | 10/1971 | Ramachandran | 75/10.17 |
| 3,945,629 | A | 3/1976 | Ragone et al. | |
| 3,948,650 | A | 4/1976 | Flemings et al. | |
| 3,951,651 | A | 4/1976 | Mehrabian et al. | |
| 3,954,455 | A | 5/1976 | Flemings et al. | |
| 4,089,680 | A | 5/1978 | Flemings et al. | |

(Continued)

OTHER PUBLICATIONS

Beer et al. Future technologies for energy-efficient iron and steel making, Annu. Rev. Energy Environ. 1998, vol. 23, p. 123-205.*

(Continued)

*Primary Examiner* — Roy King
*Assistant Examiner* — Xiaowei Su
(74) *Attorney, Agent, or Firm* — Hamilton, Brook, Smith & Reynolds, P.C.

(57) ABSTRACT

The invention is directed to a method of making liquid metal compositions containing a large number of solid particles per unit volume, without external heat removal, which solid particles act as nuclei for grains when the metal is solidified. A method of forming a metal solid includes the step of partially removing a solute of a liquid metallic solution which is at its liquidus temperature to partially solidify a metal solvent component, thereby forming a solid fraction, wherein there is essentially no reduction in temperature of the liquid metallic solution and solid fraction. The method further includes the step of subsequently lowering the temperature of the liquid metallic solution and solid fraction to solidify the remaining liquid metallic solution and thereby form a solid that includes the solid fraction formed during the step of partial solute removal. In an embodiment, the method further includes turbulence from gas evolution which aids in solid particle formation and grain refinement.

20 Claims, 1 Drawing Sheet

(56) References Cited

U.S. PATENT DOCUMENTS

| | | | | |
|---|---|---|---|---|
| 4,324,584 | A * | 4/1982 | Marizy | 75/553 |
| 4,567,937 | A | 2/1986 | Ujiie et al. | |
| 5,572,544 | A * | 11/1996 | Mathur et al. | 373/8 |
| 6,428,636 | B2 | 8/2002 | Doutre et al. | |
| 6,645,323 | B2 | 11/2003 | Flemings et al. | |
| 6,918,427 | B2 | 7/2005 | Yurko et al. | |
| 6,935,406 | B2 | 8/2005 | Flemings et al. | |
| 2002/0048529 | A1 * | 4/2002 | Kucharczyk et al. | 420/72 |
| 2005/0126737 | A1 | 6/2005 | Yurko et al. | |
| 2006/0060028 | A1 * | 3/2006 | Cameron et al. | 75/533 |

OTHER PUBLICATIONS

International Preliminary Report on Patentability and Written Opinion, International Application No. PCT/US2010/027575, date of mailing Sep. 29, 2011.

Ragone, D.V., *Thermodynamics of Materials*, vol. 1, pp. 211-212 (John Wiley & Sons, 1995).

Notification of Transmittal of the International Search Report and Written Opinion of the International Searching Authority, or the Declaration, International Application No. PCT/US2010/027575, Date Mailed: Oct. 27, 2010.

* cited by examiner

METHOD OF REFINING THE GRAIN STRUCTURE OF ALLOYS

RELATED APPLICATION

This application is the U.S. National Stage of International Application No. PCT/US2010/027575, filed 17 Mar. 2010, which designates the U.S., published in English, and claims the benefit of U.S. Provisional Application No. 61/210,500, filed 19 Mar. 2009. The entire teachings of the above applications are incorporated herein by reference.

BACKGROUND OF THE INVENTION

Grain refinement is a technique for improving the characteristics of metal alloys. Fine grained solidification structures possess improved properties for subsequent working and generally improved strength in the final product. A method of refining grain size in some metals is addition of grain refining compound (e.g., TiB in the case of aluminum alloys). In other cases, notably iron-carbon alloys, no effective grain refining agent exists.

A grain refining method that can be used for improving iron-carbon alloys is to heat the alloy to a temperature above its liquidus temperature, followed by stirring and controlled cooling of the melt to below its liquidus temperature, by, for example, pouring the alloy at a temperature near its liquidus temperature into a cooling vessel, so that initial solidification takes place while convection from the pouring remains significant. Significant process limitations, however, include the difficulty in controlling heat removal from the vessel walls and in sustaining sufficient convection to effect the desired formation of solid particles and their uniform distribution in the melt. Convection can be introduced by mechanical or electromagnetic methods, as described in, for example, U.S. Pat. No. 4,567,937 to Ujiie et al., issued Feb. 4, 1986, but these methods add to the cost and are not always effective.

Semi-solid metal alloy compositions with a relatively high solids content (e.g., greater than about 10 wt %) are desirable because they are thixotropic and therefore can be cast into molds and handled as solids before the molded shapes are fully solidified, increasing the number of castings produced per mold per given amount of time, as described in U.S. Pat. No. 3,954,455 to Flemings et al. issued May 4, 1976. Nevertheless, a considerable amount of time is typically required to cool the slurry to the desired solids content.

Therefore, a method is needed to produce solid particles in metal alloys that overcomes or minimizes the above-referenced problems.

SUMMARY OF THE INVENTION

The invention generally is directed to a method of making metal compositions containing a large number of solid particles per unit volume, without external heat removal. In one embodiment, a method of forming a metal solid includes the step of partially removing a solute of a liquid metallic solution which is at its liquidus temperature to partially solidify a metal solvent component, thereby forming a solid fraction, wherein there is essentially no reduction in temperature of the liquid metallic solution and solid fraction. The method further includes the step of subsequently lowering the temperature of the liquid metallic solution and solid fraction to solidify the remaining liquid metallic solution and thereby form a solid that includes the solid fraction formed during the step of partial solute removal to act as nuclei for the formation of solid grains. The step of partial removal of the solute can include a chemical reaction with a reactant in or at the interface between the metal solvent and the solid fraction. The method can further include the step of adding an excess of reactant to the liquid metallic solution to bring the temperature of the liquid metallic solution to its liquidus temperature prior to the step of forming a solid fraction.

In another embodiment, partial removal of the solute includes volatilization of a portion of the solute. In that embodiment, the liquid metallic solution can be a copper-zinc alloy and the solute can be zinc. The method can further include the step of volatilization of a portion of the solute to bring the liquid metallic solution to its liquidus prior to the step of forming a solid fraction.

In certain embodiments, partial removal of the solute generates a gas at a rate that causes turbulence of the liquid metallic solution during partial solidification. This turbulence is beneficial in promoting fine grains and in distributing them in the bath. In those embodiments, the method can further include the addition of a gas-removing material after the step of partially removing a solute and before the step of lowering the temperature of the liquid metallic solution. In other embodiments, the method can include the addition of an alloying material after the step of partially removing a solute and before the step of lowering the temperature of the liquid metallic solution. In some embodiments, the liquid metallic solution is an iron-carbon alloy, the solute is carbon, the reactant is an oxide that reacts with the carbon solute to form carbon monoxide at the temperature of the liquid metal solution, the gas-removing material is silicon or aluminum, and the alloying material is chromium or manganese or combinations thereof. In one embodiment, the oxide is an iron oxide. In some embodiments, the reactant is air. In other embodiments, the reactant is a gas mixture of oxygen and an inert gas, the gas mixture containing oxygen in a range of between about 15 vol % and about 100 vol %. The inert gas can be argon, or helium, or any combination thereof. In another embodiment, the weight percent carbon of the iron-carbon alloy is up to about 4 wt % carbon before the partial removal of solute. In yet another embodiment, the weight percent carbon of the iron-carbon alloy is up to about 4 wt % carbon before the partial removal of solute, and the weight percent carbon of the iron-carbon alloy is greater than zero after the partial removal of the solute. In some embodiments, the solid fraction is about 30% by weight or less of the combined liquid metallic solution and solid fraction at the time the temperature is lowered to form the metal solid.

This invention has many advantages. An advantage of the methods of this invention of making metal compositions containing solid particles without external heat removal is the ability to achieve grain refinement in metals where grain refining agents are not effective. An additional advantage is higher efficiency of metal processing, because solid particles form in the melt at essentially constant temperature, eliminating the delay that was necessary for temperature reduction in other methods of producing iron-carbon alloys containing solid particles. A further advantage is the ability to achieve high fraction solid and semi-solid alloys rapidly and effectively without the need to reduce temperature.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

Figure 1A:
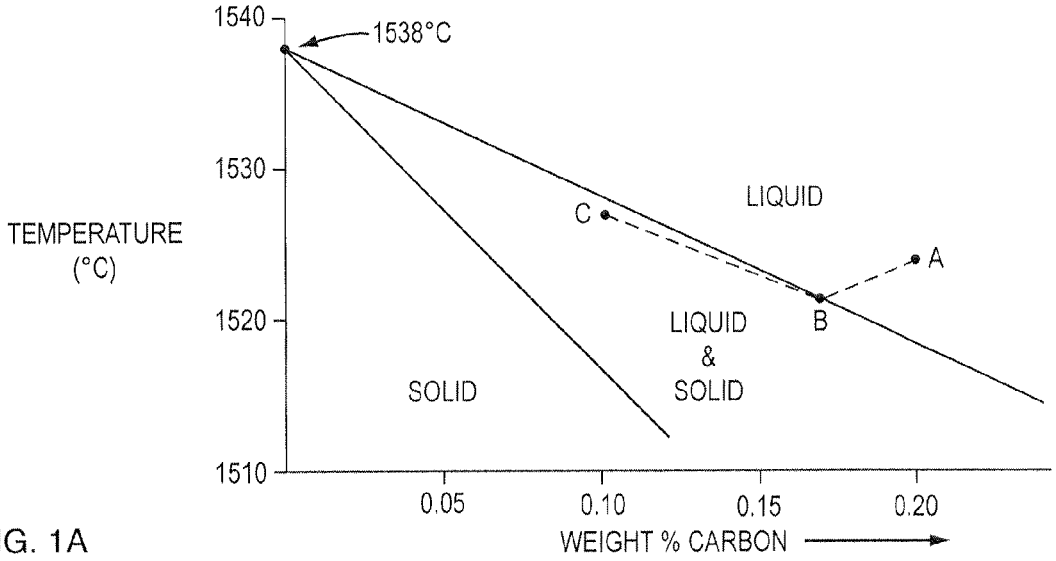
FIG. 1A is an illustration of a phase diagram showing partial carbon removal from an iron-carbon alloy from about 0.17 wt % carbon to about 0.1 wt % carbon.

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

The invention generally is directed to a method of making liquid metal compositions containing a large number of solid particles per unit volume, without external heat removal. In one embodiment of the process, a melt of an alloy is formed in a vessel by raising the temperature of the alloy to at least its liquidus temperature. The liquidus temperature of an alloy is the maximum temperature at which solid particles (crystals) can coexist with the liquid melt in thermodynamic equilibrium. Above the liquidus temperature, the melt is homogeneous, containing no solid particles. Once the liquid melt has reached at least its liquidus temperature, the method of forming a metal solid includes partially removing a solute of a liquid metallic solution to partially solidify a metal solvent component, thereby forming a solid fraction, with essentially no reduction in temperature of the liquid metallic solution and solid fraction.

As shown in FIG. 1A, for an iron-carbon alloy with an initial content of about 0.17 wt % carbon at its liquidus temperature, about 1525° C., (point B in FIG. 1A), the addition of about 0.5 kg of iron oxide per 100 kg of liquid alloy removes a sufficient amount of carbon by the endothermic chemical reaction $$FeO(liq)+C(in\ solution)=CO(gas)+Fe(liq) \quad (1)$$

to reduce the carbon content of the alloy to about 0.1 wt % carbon. The reactant, iron oxide, can have the chemical formulas FeO, $Fe_2O_3$, or $Fe_3O_4$, chosen to react with the carbon solute to form carbon monoxide (CO) at the temperature of the liquid metal solution. In some embodiments, the reactant is air, or a gas mixture of oxygen and an inert gas, such as, for example, argon or helium, the gas mixture containing oxygen in a range of between about 15 vol % and about 100 vol %.

Figure 1B:
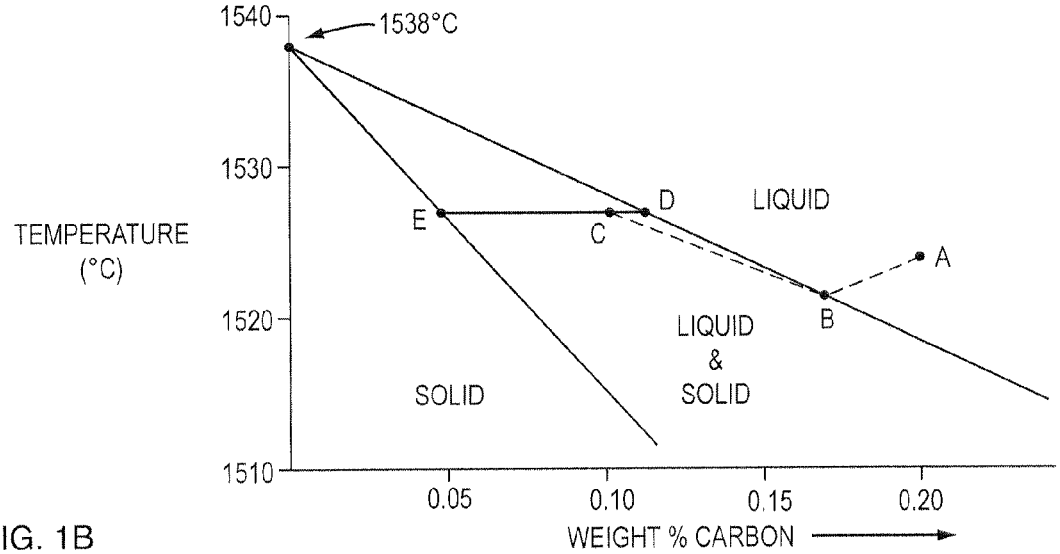
FIG. 1B is an illustration of the calculation of the solid fraction by the lever law of stoichiometry for a partial carbon removal from an iron-carbon alloy from about 0.17 wt % carbon to about 0.1 wt % carbon.

As shown in FIG. 1A, the liquidus temperature of 0.1 wt % carbon, about 1525° C., is higher than the liquidus temperature of 0.17% wt % carbon, but the temperature of the melt does not rise above the liquidus during carbon removal. Therefore, the resulting melt with 0.1 wt % carbon follows a line approximating BC, which is below its liquidus temperature, and solid particles, in this case a solid fraction of about 5 wt %, calculated by the lever law of stoichiometry, form in the melt. The lever law of stoichiometry is illustrated in FIG. 1B. The solid fraction at point C is equal to the length of the line CD divided by the length of the line ED. See e.g., Ragone, David V., *Thermodynamics of Materials*, Vol. 1, pp. 211-212 (Wiley, 1995).

There is essentially no reduction in the temperature of the liquid metallic solution and solid fraction during partial removal of the solute, at least in part because the heat released by the formation of the solid fraction counters reduction in temperature that would occur consequent to heat consumed by the endothermic reaction (1). In some embodiments, the temperature of the melt may increase slightly due to heat released by formation of the solid fraction, as shown in FIGS. 1A-B and 2, but the melt temperature always remains below the liquidus.

The chemical reaction between the reactant, iron oxide in this example, and the solute, carbon in this example, can occur in or at the interface between the metal solvent and the solid fraction. The generation of a gas, carbon monoxide (CO) in this example, can cause sufficient turbulence in the liquid metallic solution during the partial solidification to aid in increasing the number of solid particles that form, and to homogeneously distribute the solid particles in the liquid metallic solution. Alternatively, the liquid metal solution can be stirred by techniques known in the art, such as, for example, electromagnetic stirring, or by methods described in U.S. Pat. No. 6,918,427, to homogeneously distribute the solid particles. In embodiments that include gas generation, the method can further include the addition of a gas-removing material, such as, for example, silicon or aluminum in the case of iron-carbon alloys, after the step of partially removing a solute and before the step of lowering the temperature of the liquid metallic solution. In another embodiment, partial removal of the solute can be accomplished by volatilization of a portion of the solute. In this embodiment, the alloy can be a copper-zinc alloy, where the solute is zinc. In any of the above embodiments, if the temperature of the liquid metallic solution is above its liquidus temperature, as shown slightly exaggerated for clarity by point. A in FIG. 1A, the addition of an excess of reactant or the volatilization of a portion of the solute will bring the liquid metallic solution to its liquidus temperature prior to the step of forming the solid fraction.

After the formation of the solid fraction in the liquid metallic solution, the method can include the addition of an alloying material, such as chromium or manganese in the case of iron-carbon alloys, after the step of partially removing a solute and before the step of lowering the temperature of the liquid metallic solution. The temperature of the mixture is subsequently lowered to solidify the remaining liquid metallic solution and thereby form a solid that includes the fraction formed during the step of partial solute removal. The formed solid can then be processed as a typical grain-refined metal, by techniques known in the art, such as, for example, ingot casting or continuous casting. As examples of grain-refined alloys, cast aluminum alloys processed without grain refinement can have a grain size in a range of about 1-3 mm. With the addition of chemical grain refiners, grain sizes in cast aluminum alloys can be in the range of about 0.07-0.2 mm (70-200 μm). Solidification of such alloys in the presence of turbulence can reduce the grain size to the range of about 50-70 μm. There are no chemical grain refiners available for iron-carbon alloys. Grain sizes as large as 20 mm can be found in large ingots of cast iron-carbon alloys. Solidification of such alloys according to the methods of this invention can reduce the grain size of iron-carbon alloys to less than about 2 mm, preferably to a minimum grain size of about 50-100 μm, or, in another embodiment, to a grain size distribution where about 80% of the crystallites are between about 50 μm and about 600 μm in diameter or, in still another embodiment, to a grain size distribution where about 80% of the crystallites are between about 50 μm and about 400 μm in diameter.

Figure 2:
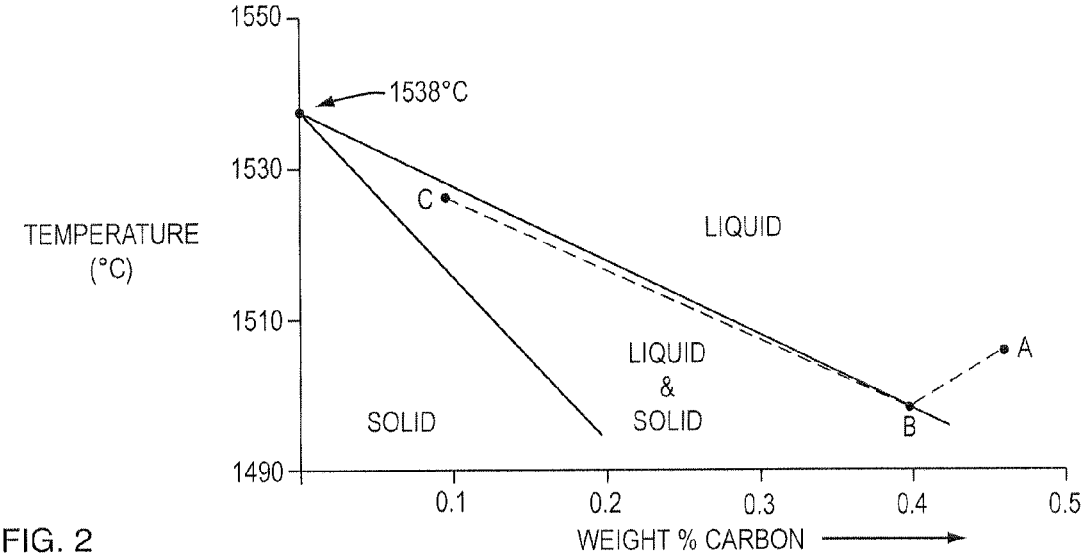
FIG. 2 is an illustration of a phase diagram showing partial carbon removal from an iron-carbon alloy from about 0.4 wt % carbon to about 0.1 wt % carbon.

In another embodiment, illustrated in FIG. 2, a 20% solid fraction semi-solid iron slurry containing about 0.1 wt % carbon can be produced by reacting about 1.7 kg of iron oxide for every 100 kg of liquid iron initially containing about 0.4 wt % carbon at its liquidus temperature, about 1497° C. The resulting semi-solid iron slurry can be processed as a semi-solid slurry, by, for example, thixocasting, or other processes known in the art, as disclosed in U.S. Pat. No. 3,948,650 to Flemings et al., issued Apr. 6, 1976. The larger solid fraction obtained in this embodiment, 20% solid fraction as compared to the 5% solid fraction produced in the embodiment illustrated in FIG. 1A, is due to the larger fraction of carbon removed from the solution. The solid fraction produced by partial solute removal according to the methods of this invention can be about 30% by weight or less of the combined liquid metallic solution and solid fraction at the time the temperature is lowered to form the metal solid. The weight percent carbon of the iron-carbon alloy that can be processed by the methods of this invention can be up to about 4 wt % carbon before the partial removal of solute. In one embodiment, the weight percent of carbon of the iron-carbon alloy is greater than zero after the partial removal of the solute.

The teachings of all patents, published applications and references cited herein are incorporated by reference in their entirety.

EQUIVALENTS

While this invention has been particularly shown and described with references to example embodiments thereof, it will be understood by those skilled in the art that various changes in form and details may be made therein without departing from the scope of the invention encompassed by the appended claims.

What is claimed is:

1. A method for refining grain of an iron-carbon alloy by forming a metal solid, comprising the steps of:

a) partially removing a solute of an iron-carbon alloy liquid metallic solution which is at its liquidus temperature to partially solidify a metal solvent component, thereby forming a solid fraction, wherein there is essentially no reduction in temperature of the liquid metallic solution and solid fraction; and b) lowering the temperature of the liquid metallic solution and solid fraction to solidify the remaining liquid metallic solution and thereby form a grain-refined solid that includes the solid fraction formed during the step of partial solute removal.

2. The method of claim 1, wherein partial removal of the solute includes a chemical reaction with a reactant in or at the interface between the metal solvent and the solid fraction.

3. The method of claim 2, further including the step of adding an excess of reactant to the liquid metallic solution to thereby bring the liquid metallic solution to its liquidus temperature prior to the step of forming a solid fraction.

4. The method of claim 1, wherein partial removal of the solute generates a gas at a rate that causes turbulence of the liquid metallic solution during the partial solidification.

5. The method of claim 4, further including the addition of a gas-removing material after the step of partially removing a solute and before the step of lowering the temperature of the liquid metallic solution.

6. The method of claim 4, further including the addition of an alloying material after the step of partially removing a solute and before the step of lowering the temperature of the liquid metallic solution.

7. The method of claim 1, wherein the solute is carbon.

8. The method of claim 7, wherein the reactant is an oxide that reacts with the carbon solute to form carbon monoxide at the temperature of the liquid metal solution.

9. The method of claim 8, wherein the oxide is an iron oxide.

10. The method of claim 2, wherein the reactant is air.

11. The method of claim 2, wherein the reactant is a gas mixture of oxygen and an inert gas, the gas mixture containing oxygen in a range of between about 15 vol % and about 100 vol %.

12. The method of claim 11, wherein the inert gas is one of argon and helium, or any combination thereof.

13. The method of claim 8, wherein the weight percent carbon of the iron-carbon alloy is up to about 4 wt % carbon before the partial removal of solute.

14. The method of claim 13, wherein the weight percent carbon of the iron-carbon alloy is up to about 4 wt % carbon before the partial removal of solute, and the weight percent carbon of the iron-carbon alloy is greater than zero after the partial removal of the solute.

15. The method of claim 13, wherein the solid fraction is about 30% by weight or less of the combined liquid metallic solution and solid fraction at the time the temperature is lowered to form the metal solid.

16. The method of claim 15, wherein partial removal of the solute generates a gas at a rate that causes turbulence of the liquid metallic solution during partial solidification.

17. The method of claim 16, further including the addition of a gas-removing material after the step of partially removing a solute and before the step of lowering the temperature of the liquid metallic solution.

18. The method of claim 16, wherein the gas-removing material is silicon or aluminum.

19. The method of claim 16, further including the addition of an alloying material after the step of partially removing a solute and before the step of lowering the temperature of the liquid metallic solution.

20. The method of claim 19, wherein the alloying material is chromium, manganese, or a combination thereof.

* * * * *